United States Patent [19]

Phillips

[11] Patent Number: 4,836,802

[45] Date of Patent: Jun. 6, 1989

[54] SEALED FUSE HOLDER

[75] Inventor: George E. Phillips, Oshkosh, Wis.

[73] Assignee: Brunswick Corporation, Skokie, Ill.

[21] Appl. No.: 213,693

[22] Filed: Jun. 30, 1988

[51] Int. Cl.[4] ..... H01R 33/95; H01R 13/52

[52] U.S. Cl. ..... 439/622; 337/187; 439/281

[58] Field of Search ..... 439/621, 622, 604–606, 439/279, 281, 722, 736, 682; 337/187, 188, 193, 201

[56] References Cited

U.S. PATENT DOCUMENTS

| | | | |
|---|---|---|---|
| 3,199,060 | 8/1965 | Marasco | 439/736 |
| 3,601,761 | 8/1971 | Harris | 439/281 |
| 3,909,767 | 9/1975 | Williamson et al. | 337/264 |
| 4,257,666 | 3/1981 | Schauer et al. | 439/736 |
| 4,560,227 | 12/1985 | Bukala . | |
| 4,759,730 | 7/1988 | Sappington et al. | 439/622 |

FOREIGN PATENT DOCUMENTS

| | | | |
|---|---|---|---|
| 2835400 | 2/1980 | Fed. Rep. of Germany | 439/736 |

OTHER PUBLICATIONS

Littelfuse Catalog, p. 33, #155 300, #155 400.

*Primary Examiner*—Gary F. Paumen
*Attorney, Agent, or Firm*—Robert C. Curfiss

[57] ABSTRACT

A sealed fuse holder (10) adapted to receive a fuse (14) having a fuse body (16) with a pair of spaced parallel male blade terminals (18, 20) extending therefrom, includes a resilient rubber electrically insulating receptacle (12) having a front face (26) with an opening (28) defining a cavity (30) extending rearwardly therefrom and having a back wall (32) spaced rearwardly from the front face and having side walls (28, 30) extending from the front face at the opening rearwardly to the back wall. A pair of spaced electrically conducting female terminal-receiving clips (22, 24) extend rearwardly from the back wall and receive respective blade terminals inserted rearwardly thereinto. A first seal (38) provides sealing from the front, and a second seal (12) including the back wall (32) provides sealing from the rear. The combination seals the electrical contact surfaces and the fusible link, and provides moisture-proof and explosion-proof sealing in marine application.

14 Claims, 2 Drawing Sheets

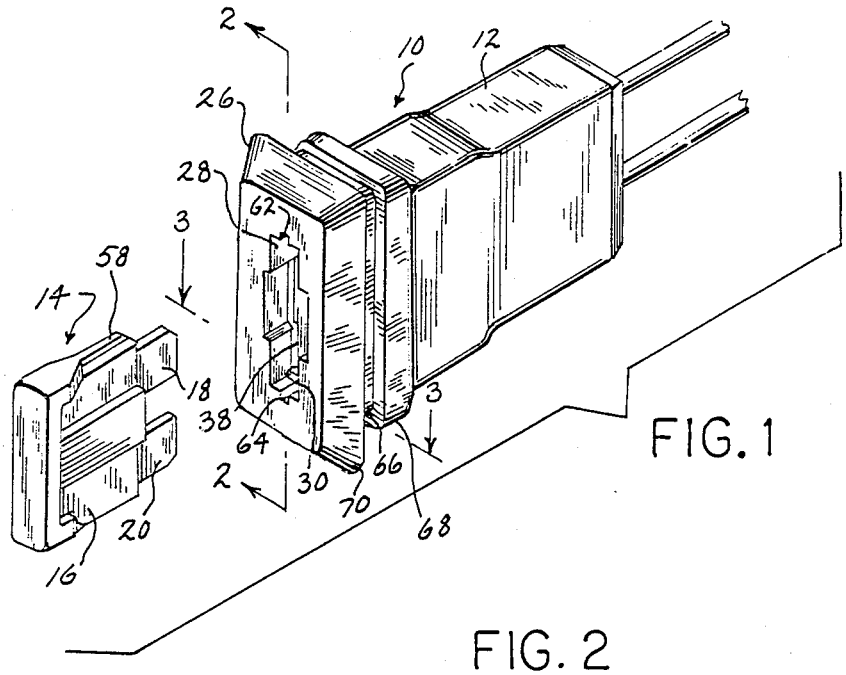
FIG. 1
FIG. 2
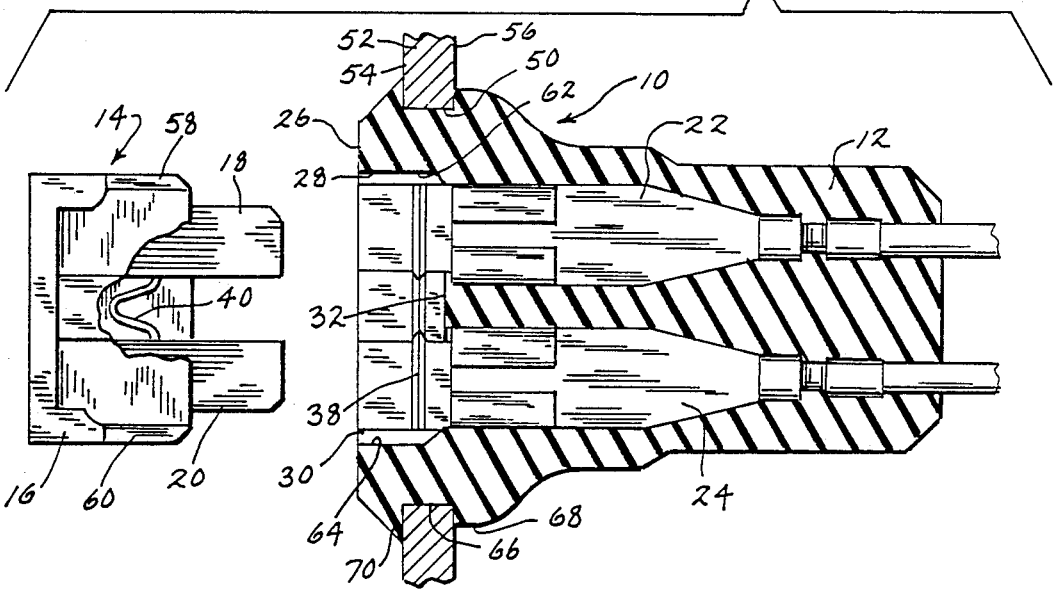
FIG. 3
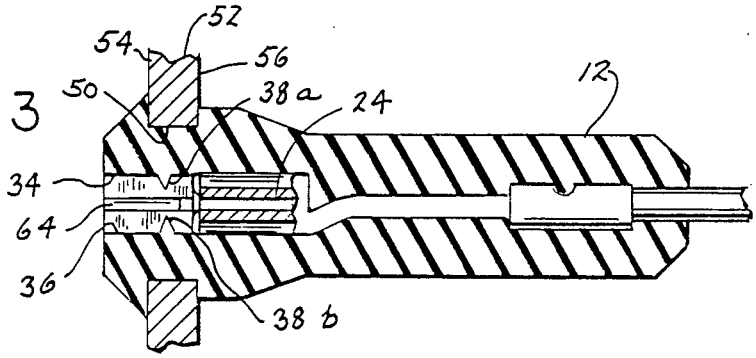

SEALED FUSE HOLDER

BACKGROUND AND SUMMARY

The present invention arose during development efforts directed toward providing a sealed fuse holder particularly for marine applications, and particularly adapted to be mounted in an aperture in a mounting panel and subject to moisture and to fuel vapor.

In marine applications, there is a need to provide a fuse holder which is both moisture-proof and explosion-proof. The present invention addresses and and solves this need. The invention provides an improved fuse holder for blade-type fuses, particularly for the above noted requirements in marine applications.

A known fuse holder is shown in U.S. Pat. No. 4,560,227, incorporated herein by reference. A known blade-type fuse is shown in U.S. Pat. No. 3,909,767, incorporated herein by reference. The noted fuse holder is neither moisture-proof nor explosion-proof. The fuse holder is open at the front and rear, and allows entry of moisture and fuel vapor to the area of the electrical contact surfaces and to the area of the fusible link. Moisture degrades the electrical contact surfaces. Fuel vapor in the area of the fusible link presents an explosion hazard.

BRIEF DESCRIPTION OF THE DRAWINGS

FIG. 1 is a perspective view of a sealed fuse holder in accordance with the invention, with a known blade-type fuse separated therefrom.

FIG. 2 is a sectional view taken along line 2—2 of FIG. 1.

FIG. 3 is a sectional view taken along line 3—3 of FIG. 1.

DETAILED DESCRIPTION

Figure 4:
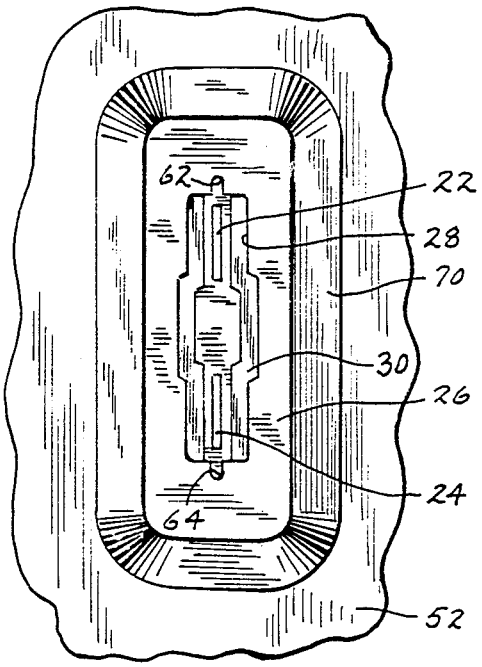
FIG. 4 is a front elevation view of the fuse holder of FIG. 1.
Figure 7:
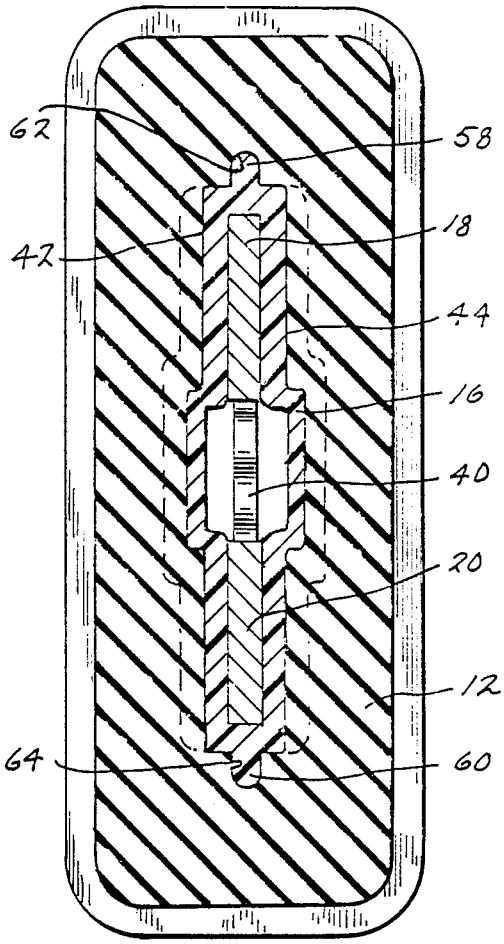
FIG. 7 is a sectional view taken along line 7—7 of FIG. 6.
Figure 5:
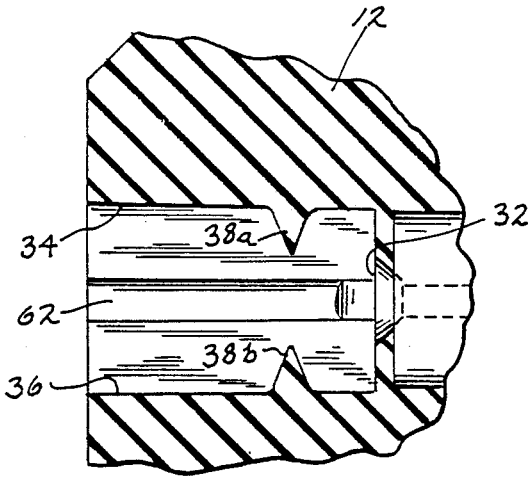
FIG. 5 is an enlarged sectional view of a portion of FIG. 3, prior to insertion of the fuse.

FIG. 1 shows a sealed fuse holder 10 comprising a resilient molded rubber electrically insulating receptacle 12 adapted to receive a fuse 14 comprising a hard plastic fuse body 16 having a pair of spaced parallel male blade terminals 18 and 20 extending therefrom. Fuse 14 is known in the art, and is shown in the above noted incorporated patents. Rubber receptacle 12 is molded in place between and around a pair of spaced electrically conducting female terminal-receiving clips 22 and 24. These clips are shown in above incorporated U.S. Pat. No. 4,560,227. Receptacle 12 has a front face 26 with an opening 28 therein defining a cavity 30 extending rearwardly therefrom, and having a back wall 32, FIGS. 2 and 5, spaced rearwardly from front face 26, and having side walls 24, 26, FIGS. 3 and 5, extending from front face 26 at opening 28 rearwardly to back wall 32. The female terminal-receiving clips 22, 24 extend rearwardly from back wall 32 within and sealed by the molded rubber receptacle 12 and receive respective blade terminals 18, 20 inserted rearwardly thereinto.

Receptacle 12 includes an integral molded rubber resilient rib 38 extending along the side walls of the cavity and engaging and being resiliently deformed by fuse body 16 in sealing relation. Cavity 30 is sealed from the front by integral molded rubber rib 38, and is sealed from the rear by the rubber receptacle 12 molded between and around female terminal-receiving clips 22 and 24. Resilient rubber rib 38 prevents entry of moisture and fuel vapor into cavity 30 rearwardly of the rib. Rib 38 engages fuse body 16 rearwardly of front face 26 and forwardly of back wall 32 and seals the space between rib 38 and back wall 32 against entry of moisture and fuel vapor from front face opening 28.

Figure 6:
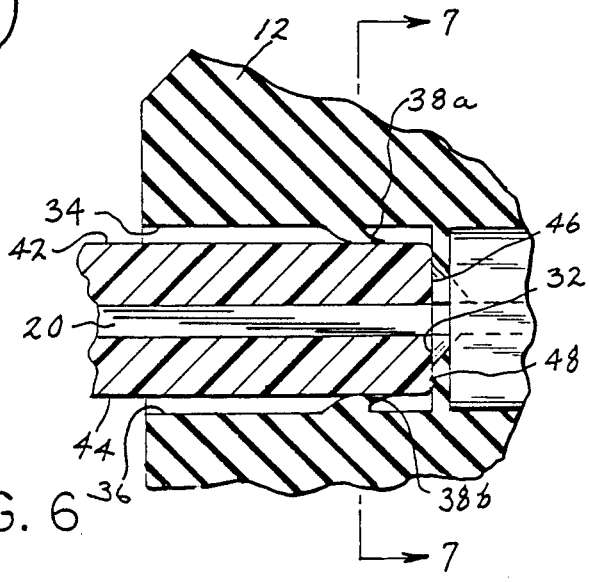
FIG. 6 is a view like FIG. 5, but showing insertion of the fuse.

Fuse body 16 is a generally flat planar member with coplanar blade terminals 18 and 20 in the plane of the fuse body and separated by a fusible link 40 therebetween, FIG. 2. The fuse body has opposite generally planar sides 42, 44, FIG.6, with a blade terminal such as 20 extending planarly therebetween and extending rearwardly thereof. The resilient rib 38 includes portions 38a and 38b, FIGS. 3, 5, 6, engaging each of the opposite generally planar sides 42 and 44 of fuse body 16 and deformed thereby, FIG. 6. The opposite generally planar sides 42 and 44 of fuse body 16 have rear ends 46, 48, FIG. 6, abutting against back wall 32. Fusible link 40 is forward of rear ends 46 and 48 and is sealed by back wall 32 engaging rear ends 46, 48 of the noted opposite generally planar sides of fuse body 16.

The present invention advantageously provides a sealed fuse holder particularly adapted for marine applications and particularly adapted to be mounted in an aperture 50, FIGS. 2 and 3, in a mounting panel 52 having a front side 54 and a back side 56 subject to moisture and fuel vapor. The first sealing means provided by integral molded rubber resilient rib 38 at rib portions 38a and 38b provides sealing against moisture and fuel vapor from the front. The second sealing means provided by the integral molded rubber receptacle 12 between and around female terminal-receiving clips 22 and 24 and also including back wall 32 provides sealing against moisture and fuel vapor from the rear. These first and second seals provide moisture-proof and explosion-proof sealing. The remaining portion of the front seal is provided by hard plastic channel portions 58 and 60 of fuse body 16, which are known in the art, received in channel grooves 62 and 64 of resilient molded rubber receptacle 12, which grooves are molded to conform to and be sealed by channels 58 and 60.

Fuse holder 10 is installed rearwardly through aperture 50 of panel 52 until circumferential groove 66 around the exterior of receptacle 12 is received in aperture 50 in snap-in relation. During this insertion, shoulder portion 68 of receptacle 12 is slightly compressed until it is rearward of aperture 50. Insertion is stopped by outer peripheral flange 70 around front face 26 engaging the front side 54 of panel 52. The engagement of aperture 50 of panel 52 by groove 66 of receptacle 12, and the engagement of back side 56 of panel 52 by shoulder 68 of receptacle 12, and the engagement of front side 54 of panel 52 by flange 70 of receptacle 12 seals any communication through aperture 50 between the back side 56 and the front side 54 of the panel.

It is recognized that various equivalents, alternatives and modifications are possible within in the scope of the appended claims.

I claim:

1. A sealed fuse holder adapted to receive a fuse comprising a fuse body having a pair of spaced parallel flat male blade terminals extending therefrom, comprising an electrically insulating receptacle having a front face with an opening therein defining a cavity extending rearwardly from said front face and having side walls extending from said front face at said opening rearwardly to said back wall, a pair of spaced electrically conducting female terminal-receiving clips extending rearwardly from said back wall and receiving respective said blade terminals inserted rearwardly thereinto, first sealing means in said receptacle sealing said cavity from the front, second sealing means in said receptacle sealing said cavity from the rear.

2. The invention according to claim 1 wherein said first sealing means comprises a resilient rib extending along said side walls and engaging and being resiliently deformed by said fuse body in sealing relation to prevent entry of moisture into said cavity rearwardly of said rib.

3. The invention according to claim 2 wherein said rib engages said fuse body rearwardly of said front face and forwardly of said back wall and seals the space between said rib and said backwall against entry of moisture from said front face opening.

4. The invention according to claim 3 wherein said fuse body is generally flat with coplanar said blade terminals separated by a fusible link therebetween, and wherein said fuse body has opposite generally planar sides with said blade terminals extending planarly therebetween and extending rearwardly thereof, and said resilient rib includes portions engaging each of said opposite generally planar sides of said fuse body and being deformed thereby.

5. The invention according to claim 4 wherein said opposite generally planar sides of said fuse body have rear ends abutting against said back wall, and wherein said fusible link is forward of said rear ends and sealed by said back wall engaging said rear ends of said opposite generally planar sides of said fuse body.

6. The invention according to claim 1 wherein said second sealing means comprises means extending between and around said spaced female terminal-receiving clips and sealing said cavity from the rear.

7. The invention according to claim 1 wherein said fuse body is a generally flat planar member with coplanar said blade terminals in the plane of said fuse body and separated by a fusible link therebetween, and wherein said fuse body has opposite generally planar sides with said blade terminals extending planarly therebetween and extending rearwardly thereof, and wherein said opposite generally planar sides of said fuse body have rear ends abutting against said back wall, and wherein said fusible link is forward of said rear ends, and wherein said second sealing means comprises means including said back wall extending between and around said spaced female terminal-receiving clips and also engaging said rear ends of said opposite planar sides of said fuse body and sealing said cavity and said fusible link from the rear.

8. A sealed fuse holder adapted to receive a fuse comprising a fuse body having a pair of spaced parallel male blade terminals extending therefrom, comprising an electrically insulating receptacle having a front face with an opening therein defining a cavity extending rearwardly therefrom and having a backwall spaced rearwardly from said front face and having side walls extending from said front face at said opening rearwardly to said back wall, a pair of spaced electrically conducting female terminal-receiving clips extending rearwardly from said back wall and receiving respective said blade terminals inserted rearwardly thereinto, combination sealing means comprising first sealing means in said receptacle sealing said cavity from the front and second sealing means in said receptacle sealing said cavity from the rear, said first sealing means comprising a resilient rib extending along said side walls and engaging and being resiliently deformed by said fuse body in sealing relation to prevent entry of moisture and vapor into said cavity rearwardly of said rib, said rib engaging said fuse body and sealing the space between said rib and said back wall against entry of moisture and vapor from said front face opening, said fuse body being a generally flat planar member with coplanar said blade terminals in the plane of said fuse body and separated by a fusible link therebetween, said fuse body having opposite generally planar sides with said blade terminals extending planarly therebetween and extending rearwardly thereof, said resilient rib including portions engaging each of said opposite generally planar sides of said fuse body and deformed thereby, said opposite generally planar sides of said fuse body having rear ends abutting against said back wall, said fusible link being forward of said rear ends and sealed by said back wall engaging said rear ends of said opposite generally planar sides of said fuse body, said second sealing means comprising means including said back wall extending between and around said spaced female terminal-receiving clips and also engaging said rear ends of said opposite planar sides of said fuse body and sealing said cavity and said fusible link from the rear.

9. A sealed fuse holder adapted to receive a fuse comprising a fuse body having a pair of space parallel flat blade terminals extending therefrom, comprising a resilient molded rubber electrically insulating receptacle molded in place between and around a pair of spaced electrically conducting female terminal-receiving clips, said receptacle having a front face with an opening therein defining a cavity extending rearwardly therefrom and having a back wall spaced rearwardly from said front face at said opening walls extending from said front face at said opening rearwardly to said back wall, wherein said female terminal-receiving clips extend rearwardly from said back wall within and sealed by said molded rubber receptacle and receiving respective said blade terminals inserted rearwardly thereinto, said receptacle including an integral molded rubber resilient rib extending along said side walls and engaging and being resiliently deformed by said fuse body in sealing relation, wherein said cavity is sealed from the front by said integral molded rubber rib, and is sealed from the rear by said rubber receptacle molded between and around said female terminal-receiving clips.

10. The invention according to claim 9 wherein said fuse body is generally flat with coplanar said blade terminals separated by a fusible link therebetween, and wherein said fuse body has opposite generally planar sides with said blade terminals extending planarly therebetween and extending rearwardly thereof, and wherein said opposite generally planar sides of said fuse body have rear ends abutting against said back wall, and wherein said fusible link is forward of said rear ends, and wherein said second sealing means comprises said molded rubber receptacle extending between and around said spaced female terminal-receiving clips and also engaging said rear ends of said opposite planar sides of said fuse body and sealing said cavity and said fusible link from the rear.

11. A sealed fuse holder particularly for marine applications and particularly adapted to be mounted in an aperture in a mounting panel having a front side, and a back side, said fuse holder receiving a fuse comprising a fuse body having a pair of spaced parallel flat male blade terminals extending therefrom, said fuse holder comprising an electrically insulating receptacle having a front face with an opening therein defining a cavity extending rearwardly therefrom and having a back wall spaced rearwardly from said front face and having side walls extending from said front face at said opening rearwardly to said back wall, a pair of spaced electrically conducting female terminal-receiving clips extending rearwardly from said back wall and receiving respective said blade terminals inserted rearwardly thereinto, moisture-proof and explosion-proof sealing means preventing entry of moisture and fuel vapor into said cavity from said front side of said panel and from said back side of said panel comprising first sealing means in said receptacle sealing said cavity from the front and second sealing means in said receptacle sealing said cavity from the rear.

12. The invention according to claim 11 wherein said first sealing means is spaced forwardly of said back wall, and wherein said second sealing means includes said back wall.

13. The invention according to claim 12 comprising in combination third sealing means sealing communication through said aperture between said back side and said front side of said panel.

14. The invention according to claim 13 wherein said third sealing means comprises a circumferential groove around the exterior of said receptacle engaging said aperture in said panel, in combination with a peripheral shoulder around said receptacle rearward of said groove and engaging said back side of said panel, and in combination with a peripheral flange around said receptacle forward of said groove and engaging said front side of said panel.

* * * * *

UNITED STATES PATENT AND TRADEMARK OFFICE

CERTIFICATE OF CORRECTION

PATENT NO. : 4,836,802

DATED : June 6, 1989

INVENTOR(S) : GEORGE E. PHILLIPS

It is certified that error appears in the above-identified patent and that said Letters Patent is hereby corrected as shown below:

Column 1, Line 60, delete "24, 26" and substitute therefore -- 34, 36 --; Claim 1, Col. 3, Line 2, after "rearwardly" insert -- therefrom and having a back wall spaced rearwardly --; Claim 9, Col. 4, Line 40, after "face" delete "at said opening" and substitute therefore -- and having side --.

Signed and Sealed this

Twenty-seventh Day of November, 1990

*Attest:*

HARRY F. MANBECK, JR.

*Attesting Officer*

*Commissioner of Patents and Trademarks*